US006091597A

United States Patent [19]

Lin

[11] Patent Number: 6,091,597

[45] Date of Patent: Jul. 18, 2000

[54] STRUCTURE OF AN ELECTRIC SHOCK DEVICE

[76] Inventor: Ming-Chen Lin, No. 17, Lane 242, Jen Ai Road, Sec. 2, Tantze Hsiang, Taichung Hsien, Taiwan

[21] Appl. No.: 09/145,440

[22] Filed: Sep. 1, 1998

[51] Int. Cl.[7] ..... H01G 23/00

[52] U.S. Cl. ..... 361/232; 361/115

[58] Field of Search ..... 361/232, 115

[56] References Cited

U.S. PATENT DOCUMENTS 4,486,807 12/1984 Yanez ..... 361/232

4,842,277 6/1989 La Croix ..... 361/232

*Primary Examiner*—Stephen Jackson

*Attorney, Agent, or Firm*—Rosenberg, Klein & Lee

[57] ABSTRACT

An improved structure of an electric shock device includes a handle, and a plurality of retractable rod portions. The handle has an interior accommodating therein a high voltage generator and a battery unit. The handle further has a control switch at a lower rim thereof. The retractable rod portions are arranged and assembled in order of size, and equipped with a retractable function by utilizing springs and retaining rods disposed therein. The rod portions are made of insulating materials and respectively provided with parallel positive and negative electrode plates on both sides thereof. The electrode plates nearest to the handle are connected to positive and negative terminals of the high voltage generator so as to supply the rod portions with the required high voltages. The permittivity of dielectrics on the rod portions that have different diameters is caused to be equivalent so that the conductance conditions of the rod portions are the same, and the rod portions can all generate electric arcs.

4 Claims, 8 Drawing Sheets

STRUCTURE OF AN ELECTRIC SHOCK DEVICE

BACKGROUND OF THE INVENTION (a). Field of the Invention

The present invention relates generally to an improved structure of an electric shock device, and more particularly to an electric shock device that is quick to assemble, and has good strength and a high voltage discharge balancing device to achieve good electric shock effects.

(b). Description of the Prior Art

The electric shock device (baton) is a kind of self-defense tool. Whether its structural strength is good and whether the electric shock effects are satisfactory are critical to whether it can effectively threaten attackers. There are various drawbacks with conventional electric shock devices as described hereinafter.

FIG. 1 shows a winding retractable type electric shock device 1, which is an equidistant electric discharge device. It mainly comprises a handle 11 and a rod 12. The rod 12 is comprised of several segments (in general one to four segments) so that it is retractable. The interior of the handle 11 has a high voltage generator and a battery unit (not shown) for outputting high voltages to a lead wire 121 wound on the rod 12 so as to achieve electric shock effects. However, there are the following disadvantages in terms of manufacture and use thereof:

1. In order to secure and wind the lead wire 121 on the rod 12 and to enable the rod 12 to be retractable, the lead wire 121 has to be heated during processing to cause it to wind round and sink into the surface of the segments of the plastic rod 12. Such a method will damage the rigidity of the rod 12 so that its structural strength is reduced. Oftentimes, the rod 12 will break.

2. The lead wire 12 is a fine metal fire. If the attacker is armed with a sharp weapon, he can easily cut the lead wire so that the electric shock device cannot function anymore.

3. The lead wire 12 has to be wound in such a way that the pitch between turns of wire on the surface of each segment of the rod 12 is equal so that the distances d1, d2, and d3 are equivalent to thereby achieve equidistant shock effects. However, as it requires skill to make the pitch between turns of the lead wire 12 equivalent, the winding of the lead wire 12 may not be precise, so that the electric discharge voltage is concentrated on the smallest pitch, causing the generation of an electric arc. If the electric arc is frequently concentrated in a certain position, the high temperature will cause the peripheral plastic portion of the rod 12 to melt or burn, resulting in damage of the plastic insulation, hence damage of the electric shock device. There are also adverse effects on the effects and service life of the electric shock baton.

4. In the electric conductance between adjacent segments of the retractable rod 12, the conventional way is to pull a straight line and use coils but since coils will deform due to retraction of the rod, conductance may fail.

5. As the length of each segment of the retractable rod 12 is limited, it is not possible to increase the width of the pitch d1 or d2 or d3 of the (+) and (−) wire turns, so that the electric voltage at the poles (+) and (−) on the rod 12 cannot be increased.

FIG. 2 shows an electrode plate conductance fixed type electric shock device 2. In this electric shock device 2, positive and negative electrode plates 22 are mounted on both sides of a rod 21. The distance between the positive and negative electrode plates 22 is utilized to discharge electric voltages. The advantage of this device 2 is that the discharge distances d4 at the front and at the back are equivalent, so that loss of electric voltage is less. Besides, the entire rod 21 will generate electric arcs, achieving better electric shock effects. Assembly thereof is also convenient, and the structural strength thereof is goods. However, it is not retractable and is therefore inconvenient to carry.

The inventor of the present invention has attempted to improve the above-described electrode plate conductance fixed type electric shock device 2 by making it retractable, as that shown in FIG. 3. However, the discharge distances between the respective positive and negative electrode plates 31, 31'; 32, 32'; and 33, 33' of the three segments I, II, III of the rod 1231 are not equivalent, so that a non-equidistant discharge mode is obtained, which differs from the two modes of equidistant discharge described above. And according to the discharge principles of positive and negative poles, the highest discharge voltage and the electric arc will concentrate on where the discharge distance is shortest, that is, the segment III. Hence, the discharge voltage of the segments I and II will be lowered by the segment III, affecting the electric shock effects of the electric shock device 3 as a whole.

SUMMARY OF THE INVENTION

A primary object of the present invention is to provide an improved structure of an electric shock device, in particular an electrode plate balanced conductance retractable one, which is quick to assemble and process and which has good structural strength. Besides, each segment of the device is capable of generating discharge arc to achieve enhanced electric shock effects.

Another object of the present invention is to provide an improved structure of an electric shock device in which water tightness between segments thereof is ensured.

A further object of the present invention is to provide an improved structure of an electric shock device, which is provided with a stop switch having a safety stop configuration to ensure safety in use.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
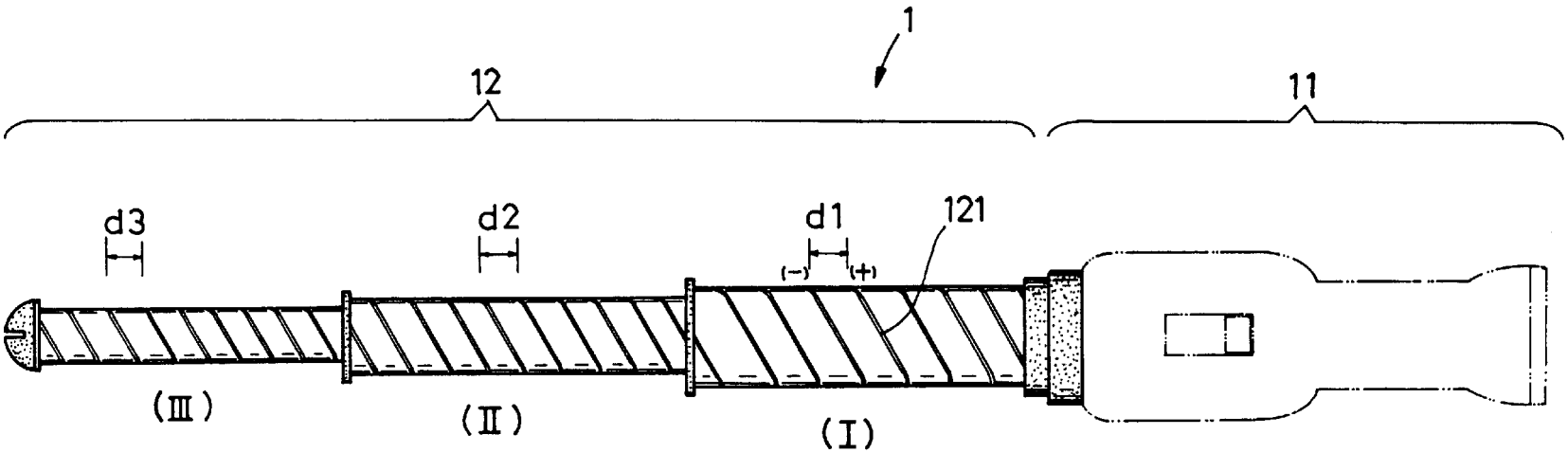
PRIOR ART FIG. 1
FIG. 1 is a schematic view of a conventional winding retractable type electric shock device.
Figure 2:
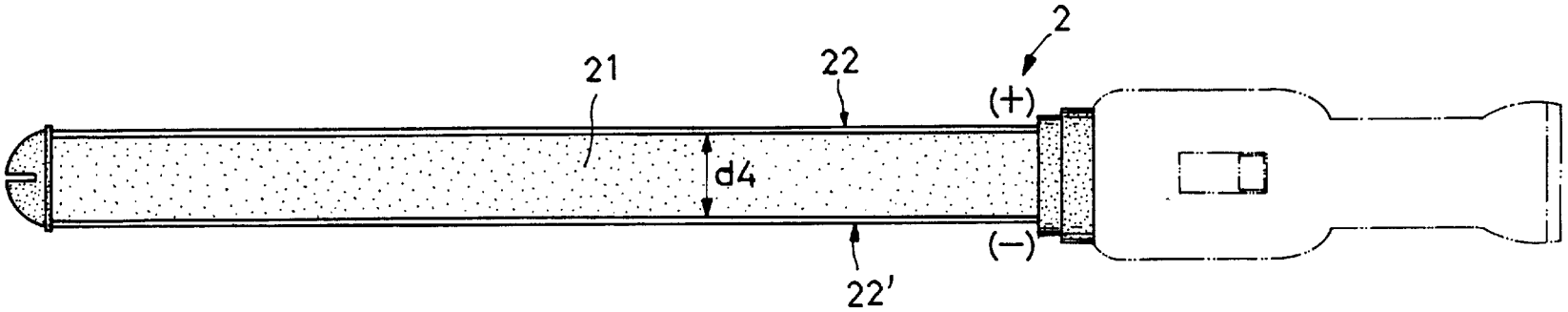
PRIOR ART FIG. 2
FIG. 2 is a schematic view of a conventional electrode plate conductance fixed type electric shock device.
Figure 3:
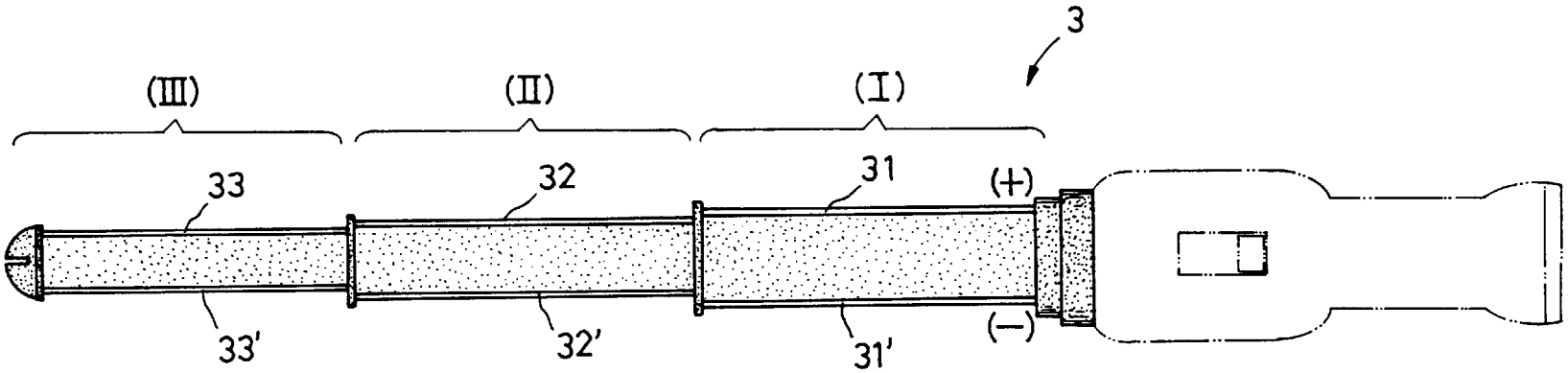
PRIOR ART FIG. 3
FIG. 3 is a schematic view of a conventional electrode plate conductance retractable type electric shock device.
Figure 4:
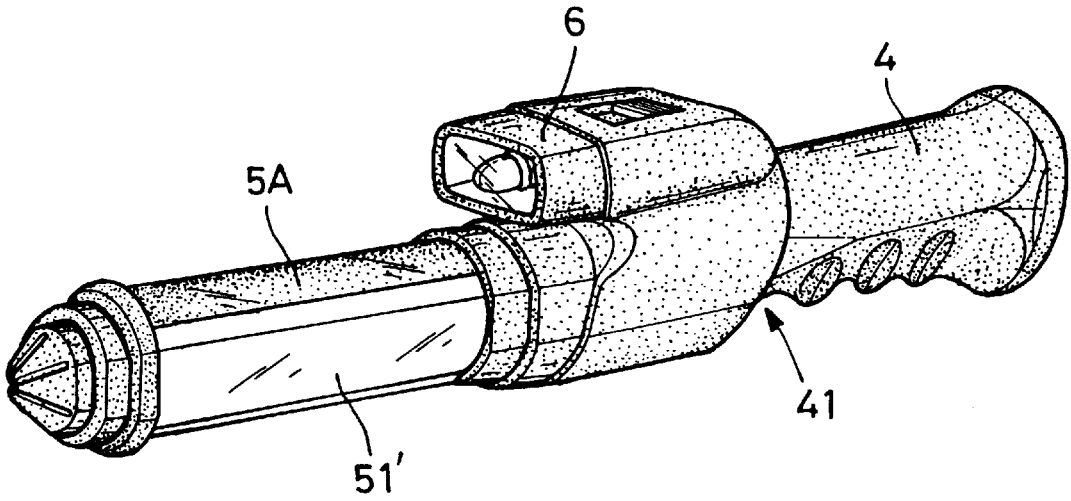
FIG. 4 is an elevational view of the present invention in a retracted state.
Figure 5:
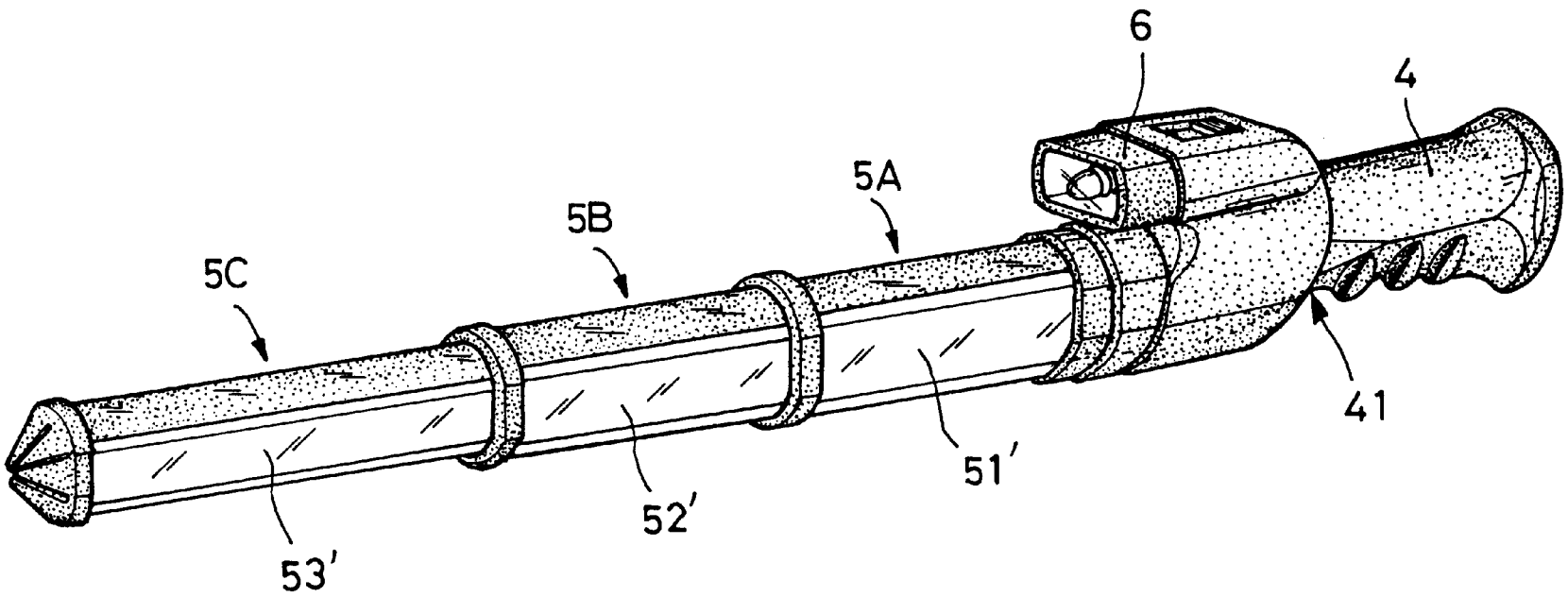
FIG. 5 is an elevational view of the present invention in an extended state.
Figure 6:
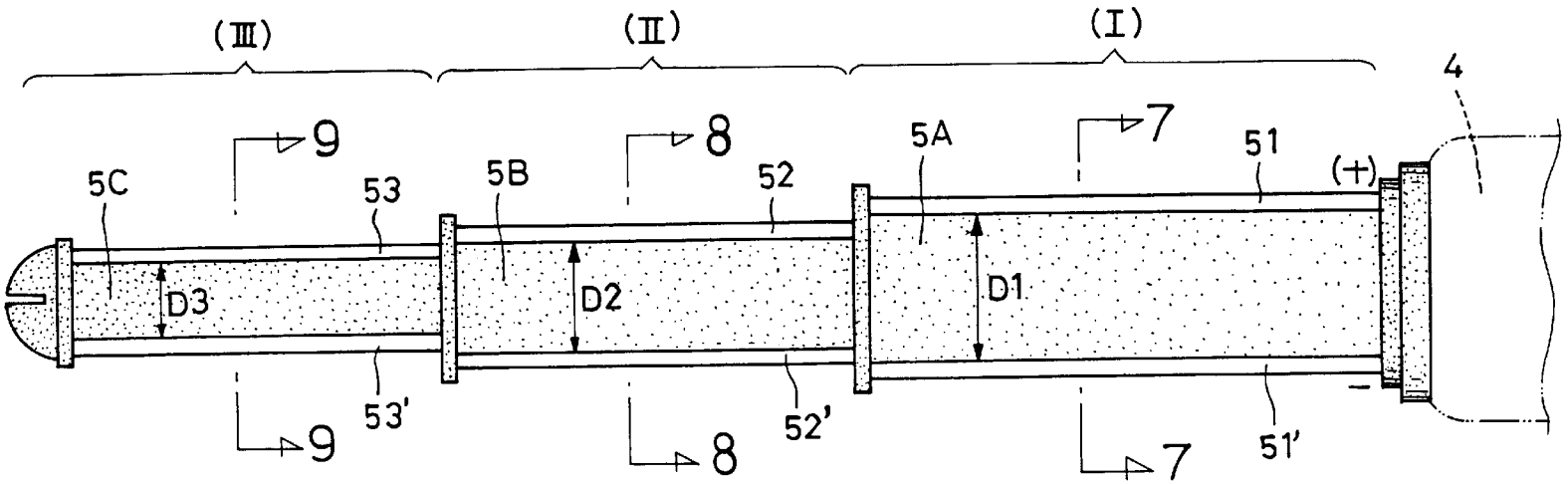
FIG. 6 is a schematic view illustrating the structure of each rod segment of the electric shock device of the present invention.
Figure 7:
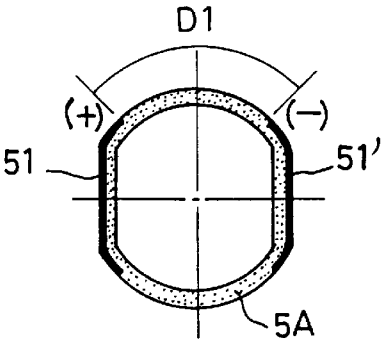
FIGS. 7 to 9 are sectional views taken along lines 7—7, 8—8, 9—9 respectively.
Figure 8:
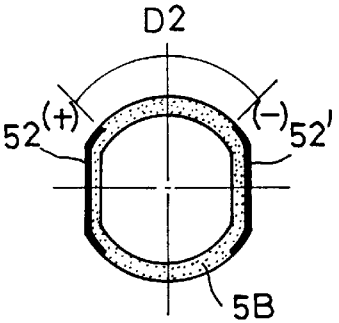
Figure 9:
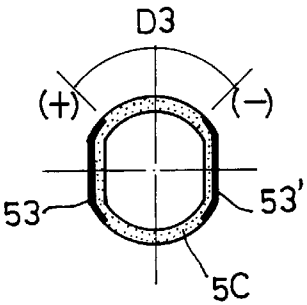

With reference to FIGS. 4 and 5, a preferred embodiment of the present invention comprises a handle 4, and a plurality of rod portions 5A, 5B, 5C.

The handle 4 has an interior accommodating a high voltage generator and a battery unit (not shown). A control switch 41 is provided at a lower rim of the handle 4.

The rod portions 5A, 5B, 5C are arranged in order of size. Springs and retaining rods (not shown) are disposed inside the rod segments to enable them to have a retractable function. As this belongs to the prior art, it will not be discussed in detail herein. Furthermore, the rod portions are made of insulated materials and provided with parallel positive and negative electrode plates 51, 51'; 52, 52'; 53, 53'. The positive and negative electrode plates 51, 51' nearest the handle 4 are connected to the positive and negative terminals of the high voltage generator so as to supply high voltages to the rod portions 5A, 5B, 5C.

The present invention is characterized in that the permittivity of dielectrics on the rod portions 5A, 5B, 5C having different diameters is caused to be equivalent so that the electric conductance conditions of the rod portions 5A, 5B, 5C are the same, and they all generate electric arcs, thus achieving a high voltage balanced discharge.

Figure 10:
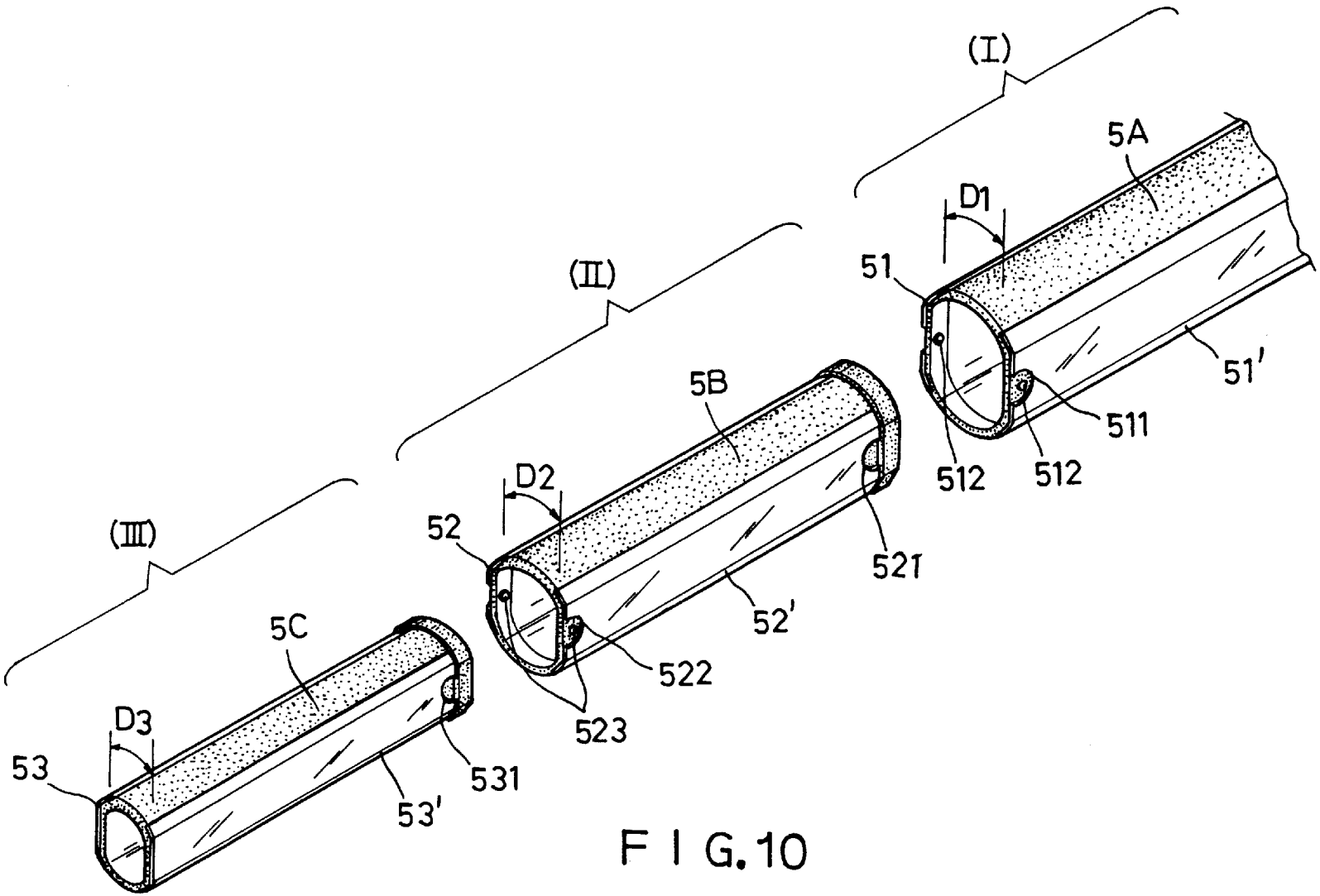
FIG. 10 is an exploded view of the main structure of each rod segment of the present invention.
Figure 10A:
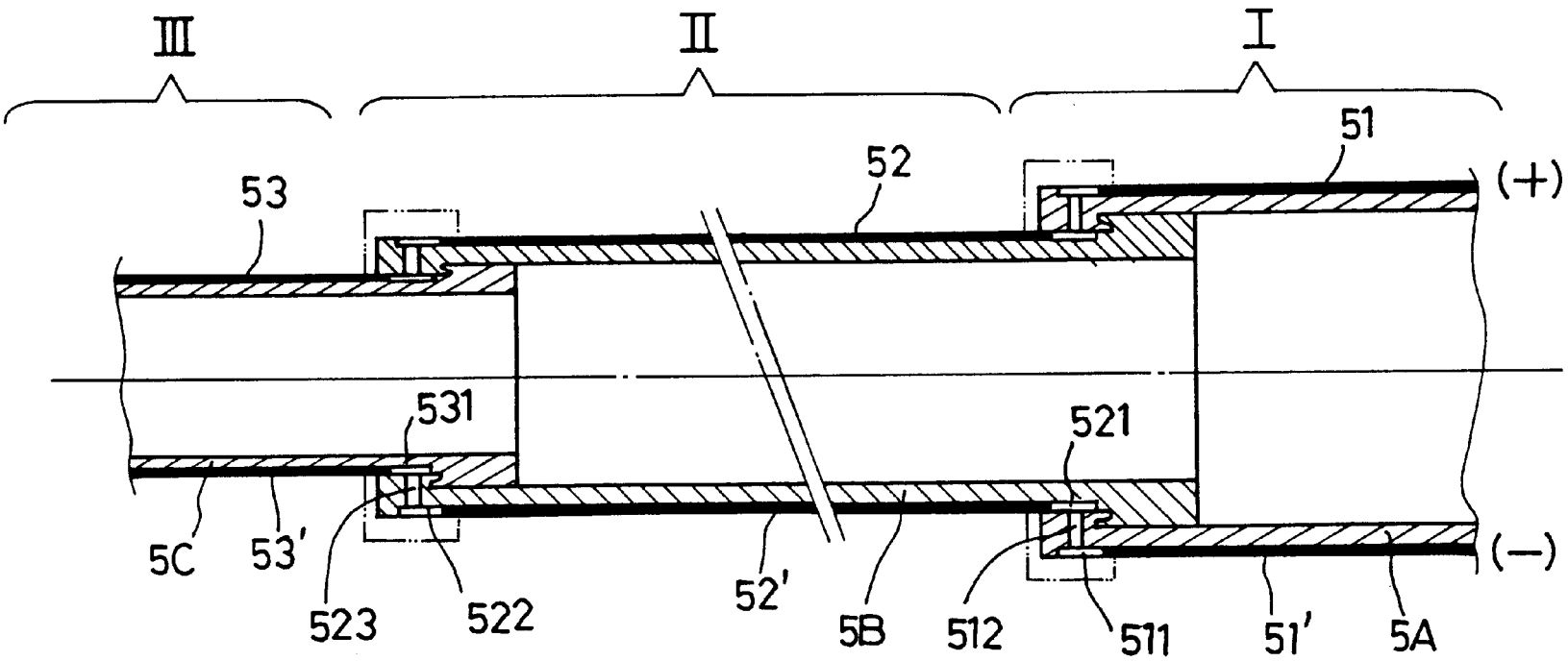
FIG. 10A is a sectional view of the device in FIG. 10, but in an assembled state.

The principle and technical means employed by the present invention are described hereinafter with reference to FIGS. 6–9. As the rod portion 5A of the segment I has the largest diameter, the discharge distance D1 between positive and negative electrode plates 51, 51' is the greatest. The diameter of segment III is smallest; therefore, the relationship among the segments I, II, III in terms of the discharge distance is: D1>D2>D3. The dielectrics of D1 to D3 are the curve pitch, and different dielectrics have different relative permittivity. For instance, the relative permittivity of air is 1.0, and different insulating materials have different relative permittivity. For example, the relative permittivity of Teflon® is 2.0; rubber 3.0; Bakelite 7.0. Therefore, if the insulating materials forming the rod segments are the same (e.g., all use plastics), then, under the condition that the dielectrics of the two electrode plates is the same, the discharge amount is in an inverse proportion to distance. In other words, if other dielectric factors are not considered, then the curve distance D3 of positive and negative electrode plates 53, 53' of rod portion 5C of segment III is the shortest. Therefore, the discharge arc will concentrate on rod portion 5C. However, as mentioned in the background part, there is the problem of discharge arc concentration. The present invention is directed to solving this problem, among others. An example of the way to overcome this problem is illustrated in FIG. 10.

Respective distal ends of positive and negative electrode plates 51, 51' of the rod portion 5A of segment I (that has the largest diameter) are provided with a small curved depression 511, and the rod portion 5A of insulating materials is provided with a radial first guide hole 512 relative to the small curved depression 511 of each electrode plate.

The front and rear ends of the positive and negative electrode plates 52, 52' of the rod portion 5B of segment II (that is the second largest in diameter) are provided with small curved depressions 521, 522, and the rod portion 5B is provided with a radial second guide hole 523 relative to the respective one of the curved depressions 522 at the rear ends of the electrode plates.

Front ends of the positive and negative electrode plates 53, 53' of the rod portion 5C of segment III (that has the smallest diameter) are provided with small curved depressions 531 respectively.

The discharge condition for the rod portion 5A of segment I is: the surface curve distance D1 of the rod portion 5A between positive and negative electrode plates 51, 51'.

The discharge condition for the rod portion 5B of segment 11 is: the surface curve distance D2+2×(the surface distance from the small curved depression 511 of rod portion 5A of segment I to the first guide hole 512+wall thickness of the first guide hole 512+air gap between coupled electrode plates of segments I and II+the surface distance from the small curved depression 521 at the front end of the electrode plate of segment II to the coupled air end).

The discharge condition for the rod portion 5C of segment III is: the surface curve distance D3+2×(the surface distance from the small curved depression 511 of rod portion 5A of segment I to the first guide hole 512+wall thickness of first guide hole 512+air gap between coupled electrode plates of segments I and II+the surface distance from the small curved depression 521 at the front end of the electrode plates of segment 11 to the coupled air end)=2×(the surface distance from the small curved depression 522 of the rear end of rod portion 5B of segment II to the second guide hole 523+wall thickness of the second guide hole 523+the air gap between electrode plates of coupled segments II and III+the surface distance from the small curved depression 531 at the front end of the rod portion 5C of segment III to the coupled air end).

Rod portions 5A, 5B, 5C made according to the above-described characteristics are caused to have identical discharge conditions, so that their relative permittivity is equivalent, and each rod portion generates a discharge arc.

Experimentation of the present invention has been conducted. The design of the small curved depressions 511, 521, 531 at ends of the electrode plates, as well as the arrangement of the first and second guide holes 512, 513, are to facilitate coupling and adjustment of distances so as to achieve balanced discharge.

Figure 11:
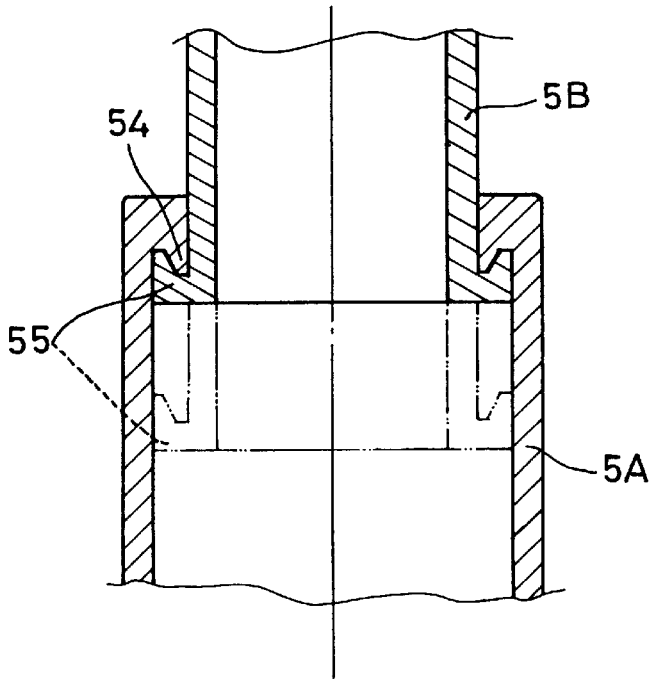
FIG. 11 is a schematic view of a water-resisting structure of each rod segment of the present invention.

Referring to FIG. 11, which illustrates the connection among the rod portions, the end opening of the largest rod portion 5*b* is provided with wedge-shaped retaining portions 54, and the rod portion 5B is provided with matching wedge-shaped retaining portions 55 so that, when the rod portions 5A, 5B, 5C are extended, they can inter-engage to prevent penetration of rainwater into the rod portions.

Figure 12:
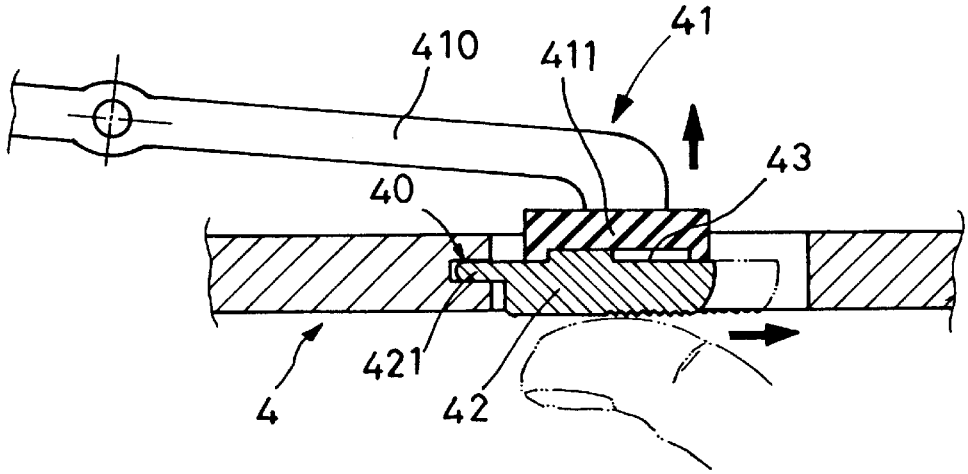
FIG. 12 is a schematic view of a control switch having a safety structure of the present invention.

Referring to FIG. 12, the control switch 14 at the handle 4 is additionally provided with a stop element 42 in contact with a press block 411 of an action link 410 that controls retraction of the rod portions. The connecting slide groove 43 is between the stop element 42 and the press block 411. A front end of the stop element 42 is provided with a projecting block 421 that can insert into a recess 40 of the handle 4. Therefore, in use, the stop element 42 can be pushed rearwardly so that the projecting block 421 is disengaged from the recess 40. Then by pressing inwardly, the action link 410 is opened so that the rod portions are ejected outwardly. Such an arrangement avoids inadvertent pressing of the press block 411 to extend the rod portions, which may hurt others.

Referring back to FIGS. 4 and 5, a light 6 may be provided at a front upper end of the handle 4. In this way, the electric shock device of the present invention can also serve as a torch.

The effects the present invention has are further described hereinafter:

1. The present invention is a high voltage discharge balanced conductance retractable type electric shock device utilizing positive and negative electrode plates. Since electrode plates are of metal, the problems with the winding retractable type electric shock devices are absent. Besides, the present invention is easy to assemble and process, and the metal electrode plates can enhance the overall strength of the present invention, providing excellent self-defense functions.

2. By means of causing the discharge conditions of the rod portions to be the same so that electric arcs are generated at all the rod portions, the high voltage at segment III will not pull down the voltages at segments I and II. Hence, the present invention has high voltage electric shock characteristics.

3. The present invention is provided with a water-resisting function and a safety switch to provide more practical effects.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved structure of an electric shock device, comprising:

a handle that has an interior accommodating therein a high voltage generator and a battery unit, the handle being provided with a control switch at a lower rim thereof; and a plurality of retractable rod portions arranged and assembled in order of size, and equipped with a retractable function by utilizing springs and retaining rods disposed therein, the rod portions being made of insulating materials and each being provided with parallel positive and negative electrode plates on both sides thereof, in which the electrode plates nearest to the handle are connected to positive and negative terminals of the high voltage generator so as to supply the rod portions with the required high voltages;

wherein the permittivity of dielectrics on the rod portions that have different diameters is caused to be equivalent so that the conductance conditions of the rod portions are the same, and the rod portions can all generate electric arcs.

2. The improved structure of an electric shock device as defined in claim 1, wherein the positive and negative electrode plates of the rod portion having the largest diameter, i.e., the first segment, are respectively provided with large and small curved depressions at rear ends thereof, and the corresponding rod portion, made of insulating materials, is provided with a radial first guide hole relative to the respective one of the small curved depressions of the electrode plates;

front and rear ends of the positive and negative electrode plates of the rod portion having a smaller diameter, i.e., the second segment, are respectively provided with a small curved depression, and the corresponding rod portion is provided with a radial second guide hole relative to the respective one of the small curved depressions at rear ends of the electrode plates;

front ends of the positive and negative electrode plates of the rod portion having the smallest diameter, i.e., the third segment, are respectively provided with a small curved depression;

wherein the discharge condition for the rod portion of the first segment is: surface curve distance D1 of rod portion between positive and negative electrode plates;

the discharge condition for the rod portion of the second segment is: surface curve distance D2+2×(surface distance from small curved depression of the first segment to first guide hole+wall thickness of first guide hole+air gap between coupled electrode plates of first and second segments+surface distance from small curved depression at front end of the electrode plate of the second segment to coupled air end);

the discharge condition for the rod portion of the third segment is: surface curve distance D3+2×(surface distance from small curved depression of rod portion of the first segment to first guide hole+wall thickness of first guide hole+air gap between coupled electrode plates of first and second segments+surface distance from small curved depression at front end of electrode plates of second segment to coupled air end)=2×(surface distance from small curved depression of rear end of rod portion of second segment to second guide hole+wall thickness of second guide hole+air gap between electrode plates of coupled first and second segments+surface distance from small curved depression at front end of rod portion of the third segment to coupled air end);

whereby rod portions invade according to the above characteristics have identical discharge conditions so that their relative permittivity is equivalent, and each rod portion generates a discharge arc.

3. The improved structure of an electric shock device as defined in claim 1, wherein joints between the rod portions are provided with matching wedge-shaped urging portions and retaining portions to ensure water tightness.

4. The improved structure of an electric shock device as defined in claim 1, wherein said handle includes an action link having a press block, said press block being provided with a safety stop element.

* * * * *